US010711749B2

(12) United States Patent
Jovovic et al.

(10) Patent No.: US 10,711,749 B2
(45) Date of Patent: Jul. 14, 2020

(54) FUEL INJECTION VALVE

(71) Applicant: CONTINENTAL AUTOMOTIVE GMBH, Hannover (DE)

(72) Inventors: Dejan Jovovic, Regensburg (DE); Hong Zhang, Tegernheim (DE); Xaver Gebhardt, Kelheim (DE)

(73) Assignee: Vitesco Technologies GmbH, Hannover (DE)

( * ) Notice: Subject to any disclaimer, the term of this patent is extended or adjusted under 35 U.S.C. 154(b) by 3 days.

(21) Appl. No.: 15/487,567

(22) Filed: Apr. 14, 2017

(65) Prior Publication Data

US 2017/0218900 A1 Aug. 3, 2017

Related U.S. Application Data

(63) Continuation of application No. PCT/EP2015/071202, filed on Sep. 16, 2015.

(30) Foreign Application Priority Data

Oct. 15, 2014 (DE) ..... 10 2014 220 877

(51) Int. Cl.
*F02M 51/06* (2006.01)
*F02M 61/20* (2006.01)
*F02M 61/10* (2006.01)

(52) U.S. Cl.
CPC .... *F02M 51/0625* (2013.01); *F02M 51/0685* (2013.01); *F02M 61/10* (2013.01); *F02M 61/20* (2013.01); *F02M 2200/306* (2013.01)

(58) Field of Classification Search
CPC ..... F02M 51/0625; F02M 51/0628; F02M 51/0642; F02M 51/0653; F02M 61/10;
(Continued)

(56) References Cited

U.S. PATENT DOCUMENTS 4,749,892 A 6/1988 Mesenich
4,984,549 A 1/1991 Mesenich
(Continued)

FOREIGN PATENT DOCUMENTS

CN 104912706 A 9/2015
DE 3314899 A1 10/1984
(Continued)

OTHER PUBLICATIONS

International Search Report and Written Opinion dated Nov. 30, 2015 from corresponding International Patent Application No. PCT/EP2015/071202.
(Continued)

*Primary Examiner* — Chee-Chong Lee
*Assistant Examiner* — Christopher R Dandridge

(57) ABSTRACT

The disclosure relates to a fuel injection valve that includes a valve needle, a closing spring applying a spring force to the valve needle, which spring force loads the valve needle in the direction of a closing position, and an actuator assembly. A coil of the actuator assembly produces a magnetic force on a magnet armature of the actuator assembly such that, as the magnet armature travels toward a pole piece of the actuator assembly, the magnet armature covers an idle stroke to a stop element of the valve needle and then carries the valve needle toward the pole piece. A spring constant of the closing spring and the magnetic force are matched such that the magnitude of the resultant force of the spring force and the magnetic force decreases with increasing distance of the valve needle from the closing position and remains the same with increasing the distance.

17 Claims, 4 Drawing Sheets

(58) Field of Classification Search
CPC ..... F02M 61/12; F02M 61/161; F02M 61/20; F02M 61/205; F02M 2200/306
See application file for complete search history.

(56) References Cited

U.S. PATENT DOCUMENTS

| | | | | |
|---|---|---|---|---|
| 5,632,447 | A | 5/1997 | Christ | |
| 5,706,778 | A | 1/1998 | Kapus | |
| 5,730,369 | A * | 3/1998 | De Nagel | F02M 51/0625 239/585.4 |
| 6,279,873 | B1 | 8/2001 | Eichendorf et al. | |
| 6,367,769 | B1 | 4/2002 | Reiter | |
| 6,520,434 | B1 | 2/2003 | Reiter | |
| 6,619,269 | B1 | 9/2003 | Stier et al. | |
| 8,166,953 | B2 | 5/2012 | Caley | |
| 9,765,738 | B2 * | 9/2017 | Izzo | F02M 51/061 |
| 2015/0090913 | A1 | 4/2015 | Buehner et al. | |
| 2015/0260135 | A1 | 9/2015 | Izzo et al. | |

FOREIGN PATENT DOCUMENTS

| | | | | |
|---|---|---|---|---|
| DE | 3408012 | A1 | 9/1985 | |
| DE | 4340874 | A1 | 6/1995 | |
| DE | 19607331 | A1 | 9/1996 | |
| DE | 19816315 | A1 | 10/1999 | |
| DE | 19849210 | A1 | 4/2000 | |
| DE | 19927900 | A1 | 12/2000 | |
| DE | 10016425 | A1 | 4/2001 | |
| DE | 19948238 | A1 | 4/2001 | |
| DE | 10345967 | A1 | 4/2005 | |
| DE | 102012207406 | A1 | 11/2013 | |
| EP | 1151190 | A1 | 11/2001 | |
| EP | 2249022 | A1 | 11/2010 | |
| EP | 2634413 | * | 2/2012 | F02M 51/06 |
| EP | 2527637 | A1 | 10/2014 | |
| EP | 2863042 | A1 | 4/2015 | |
| GB | 2204998 | * | 3/1984 | H01F 1/22 |
| GB | 2204998 | * | 11/1988 | H01F 1/22 |
| GB | 2204998 | A | 11/1988 | |
| JP | 2009526157 | A | 7/2009 | |
| JP | 2013104340 | A | 5/2013 | |
| WO | 2012/041984 | A1 | 4/2012 | |

OTHER PUBLICATIONS

Office Action, dated Jun. 30, 2015, for counterpart DE patent application 102014220877.7.
Chinese Office Action dated Aug. 29, 2018 for corresponding Chinese Patent Application No. 201580055708.x.
Korean Office Action dated Jun. 26, 2018 for corresponding Korean Patent Application No. 10-2017-7009976.
Korean Office Action dated Nov. 15, 2018 for corresponding Korean Patent Application No. 10-2017-7009976.
Korean Notice of Allowance dated Jan. 15, 2019 for corresponding Korean Patent Application No. 10-2017-7009976.

* cited by examiner

FUEL INJECTION VALVE

CROSS-REFERENCE TO RELATED APPLICATIONS

This application claims the benefit of PCT Application PCT/EP2015/071202 filed Sep. 16, 2015, which claims priority to German Application DE 10 2014 220 877.7, filed Oct. 15, 2014. The disclosures of the above applications are incorporated herein by reference

TECHNICAL FIELD

The disclosure relates to a fuel injection valve.

BACKGROUND

Fuel injection valves are known, in which the armature covers a predefined idle stroke before it engages on the valve needle, in order to move the latter out of the closed position. For example, WO 2012/041984 A1 discloses a fuel injection valve of this type.

In fuel injection valves of this type, an oscillating profile of the needle position around a predefined open position can occur when the predefined open position of the valve needle is reached. The oscillating profile influences the fuel quantity which is output by the fuel injection valve. The exact profile of the oscillations can be predicted only with difficulty. In addition, the oscillations can lead to the fuel quantity no longer being dependent linearly or even no longer monotonously on the valve opening time. The non-linear, in particular oscillating profile of the quantity characteristic curve is also called an "S-shape".

SUMMARY

It is therefore an object of the present disclosure to specify a fuel injection valve, by way of which particularly precise fuel metering and/or a particularly simple actuating capability may be achieved.

One aspect of the disclosure provides a fuel injection valve. The fuel injection valve has a valve assembly. The valve assembly has a displaceably mounted valve needle and a valve seat. The valve needle and the valve seat interact mechanically with one another, in order to prevent fuel flow through an injection opening of the fuel injection valve in a closed position of the valve needle and to release the fuel flow in other positions of the valve needle.

Implementations of the disclosure may include one or more of the following optional features. In some implementations, the fuel injection valve has a prestressed closing spring that exerts a spring force on the valve needle. The spring force loads the valve needle in the direction of the closed position. Moreover, the fuel injection valve has an electromagnetic actuator assembly which has a coil, a pole piece and a magnet armature.

In some implementations, the magnet armature is mounted such that it can be displaced with respect to the valve needle. The valve needle has a stop element, from which the magnet armature is spaced apart in a rest state of the fuel injection valve. In some examples, the armature is spring-loaded by an armature restoring spring in the direction away from the stop element.

The coil is configured to generate a magnetic force on the magnet armature when it is energized for releasing the fuel flow through the injection opening, in order to move the magnet armature toward the pole piece. On its path toward the pole piece, the magnet armature at first covers an idle stroke toward the stop element and subsequently enters into a positively locking connection with the latter, with the result that it drives the valve needle in the direction of the pole piece. Here, it transmits, in particular, the magnetic force at least partially to the valve needle, to accelerate the latter and/or to move it counter to the flow resistance as a result of the fuel in the valve assembly.

A spring constant of the closing spring and the magnetic force of the actuator assembly are adapted to one another such that the magnitude of the summed force of the spring force and the magnetic force remains constant with an increasing spacing of the valve needle from the closed position or, preferably, decreases with an increasing spacing of the valve needle from the closed position. In other words, the difference between the magnetic force and the spring force is independent of the spacing of the valve needle from the closed position, or the difference between the magnetic force and the spring force preferably drops with an increasing spacing of the valve needle from the closed position.

In some implementations, the fuel injection valve has a stopper that limits the movement of the magnet armature and/or the valve needle toward the pole piece. The stopper is formed, for example, by the pole piece or is fastened in a stationary manner with respect to the pole piece, for examples, the stopper is fastened to the pole piece. The spring constant of the closing spring and the magnetic force of the actuator assembly may be adapted to one another in such a way that the summed force is directed away from the closed position when the magnet armature and/or the valve needle come/comes into contact with the stopper. In some examples, when the magnet armature and/or the valve needle come/comes into contact with the stopper, the summed force has a magnitude that is at most half as great as the magnitude of the summed force on the valve needle when leaving the closed position, for example, in the case of an identical current through the coil.

In some examples, the magnitude of the magnetic force remains constant with an increasing spacing of the valve needle from the closed position. To this end, the coil may be loaded, for example, with an operating current that drops with an increasing spacing of the valve needle from the closed position. In this case, the magnitude of the summed force drops with an increasing spacing of the valve needle from the closed position. In some examples, the magnitude of the magnetic force increases with an increasing spacing of the valve needle from the closed position. In this case, the coil may be loaded at least temporarily with a constant operating current during the opening movement of the valve needle.

In some implementations, the magnitude of the summed force of the spring force and the magnetic force decreases with an increasing spacing of the valve needle from the closed position in the case of a constant current through the coil, or at least remains constant. In some examples, the constant current through the coil is the maximum operating current, for which the actuator assembly is designed. The maximum operating current has, for example, a value between 10 A and 18 A, the limit values being included. In some implementations, the constant current through the coil is the holding current which can be applied to the coil, in order to hold the valve in an open position, in which the magnet armature or the valve needle bears against the stopper and the stop element of the valve needle is in contact with the magnet armature. The holding current has, for example, a value between 3 A and 5 A, the limit values being included. The adaptation of the magnetic force takes place, for example, in the refinements, for example, by way of the selection of the inductance and rated current of the coil.

In conventional fuel injection valves, the closing spring has only a relatively low spring constant, with the result that the spring force is scarcely dependent on the position of the valve needle, and the rise in the magnetic force on account of the approach of the magnet armature to the pole piece can pre-dominate. The acceleration of the valve needle then rises with the spacing from the closed position. In contrast, the acceleration of the valve needle in the present fuel injection valve advantageously drops during the course of the opening movement of the valve needle. For example, the velocity of the needle (and therefore its kinetic energy) is particularly low when the magnet armature or the valve needle comes into contact with the stopper. In this way, the oscillations of the needle about the open position, in which the magnet armature or the valve needle bears against the stopper and the stop element of the valve needle is in contact with the magnet armature, advantageously have a particularly low amplitude or are even completely suppressed.

The actuator assembly may expediently be designed to hold the fuel injection valve in the open position. In some implementations, the closing spring is designed in such a way that the spring force is increased to at least 1.5 times, for example, at least doubles with respect to the prestress during the course from the closed position to the open position. In contrast, the spring force in conventional fuel injection valves is usually substantially constant over the entire needle stroke. In some examples, the prestress has a value between 5 N and 25 N, preferably between 10 N and 20 N.

In some implementations, the spring constant of the closing spring and the magnetic force of the actuator assembly are adapted to one another in such a way that the valve needle brakes by way of the flow resistance of the fuel in the valve assembly if the spacing of the valve needle from the closed position exceeds a predefined value which is, in particular, smaller than the needle stroke. For example, in the case of a predefined constant current through the coil, at first the valve needle is accelerated along part of the needle stroke when leaving the closed position and is subsequently braked over a further part of the needle stroke if the spacing exceeds the predefined value. In this way, the risk of oscillations of the valve needle about the open position is particularly low. Here, the needle stroke is the distance which the valve needle covers from the closed position as far as the open position.

In some examples, the spring constant of the closing spring and the magnetic force of the actuator assembly are adapted to one another in such a way that the magnitude of the summed force for example, in the case of a constant current through the coil. In some implementations, the fuel injection valve is designed for operation at a fuel pressure of 700 bar or less, for example, a fuel pressure of 500 bar or less. The electromagnetic actuator assembly may be designed to be so weak that it is unsuitable for moving the needle away from the closed position counter to a higher pressure of the fuel in the valve assembly. The spring constant of the closing spring may be 100 N/mm or more, for examples, the spring constant may be 300 N/mm or more.

In some implementations, the valve is designed by means of the idle stroke and the magnet armature in such a way that the force of the magnet armature on the valve needle during the entering of the positively locking connection between the magnet armature and the stop element has a value of 1.3 or more of the sum of the prestress of the closing spring and the hydraulic force which is exerted on the valve needle by the fuel in the closed position. The value may be 1.5 or more and, for example, the value may be between 2 times and 4 times the sum of the prestress of the closing spring and the hydraulic force which is exerted on the valve needle by the fuel in the closed position. In some examples, the current through the coil is at a maximum when the magnet armature comes into contact with the stop element. For example, it is then at a value which corresponds to the maximum operating current.

In this way, the valve needle is lifted up reliably from the closed position, and the valve needle passes rapidly through, in particular, at least the first third of the needle stroke. For example, the valve needle passes rapidly through at least the first 50 μm of the needle stroke.

The details of one or more implementations of the disclosure are set forth in the accompanying drawings and the description below. Other aspects, features, and advantages will be apparent from the description and drawings, and from the claims.

Identical, equivalent or identically acting elements are provided with the same designations in the figures. In some figures, individual designations can be omitted in order to improve the clarity. The figures and the proportions of the elements which are shown in the figures among one another are not to be considered to be true to scale, unless units are expressly specified. Rather, individual elements can be shown in an exaggeratedly large manner for improved representability and/or for improved comprehension.

DETAILED DESCRIPTION

Figure 1:
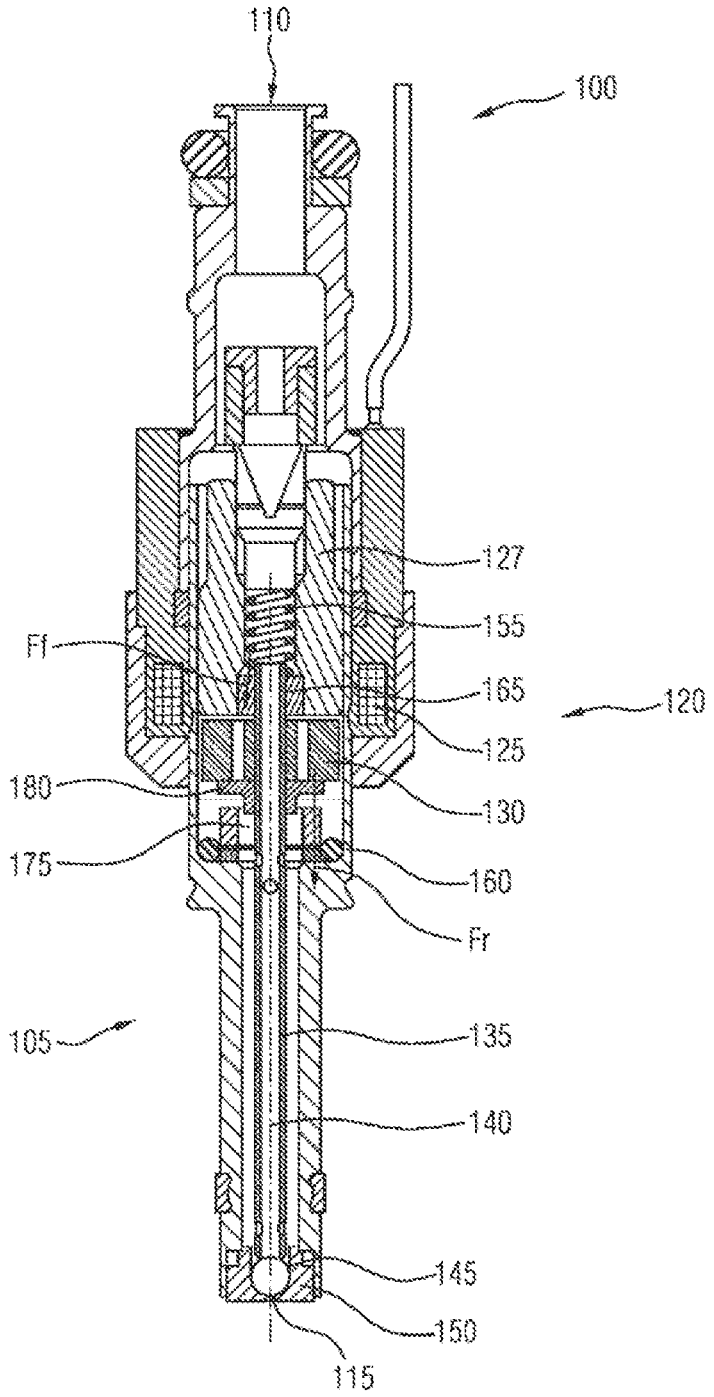
FIG 1 Prior Art
FIG. 1 shows a known fuel injection valve.

FIG. 1 shows a fuel injection valve 100 for an internal combustion engine according to the prior art in a longitudinal sectional illustration through a longitudinal axis 140 of the fuel injection valve 100.

The fuel injection valve 100 has a valve assembly 105. The valve assembly 105 has a hollow valve body 160, a valve needle 135, and a valve seat 150.

The valve needle 135 is received in the valve body 160 and is mounted such that it can be displaced with respect to the valve body 160. The valve needle 135 interacts mechanically with the valve seat 150, in order to close an injection opening 115 of the fuel injection valve 100. To this end, at its end which faces the injection opening 115, the valve needle 135 has a closing element 145 which has the basic shape of a ball in the present case.

In addition, the valve needle 135 has a stop element 165 which is arranged at an end of the valve needle 135 which lies opposite the closing element 145. A closing spring 155 of the fuel injection valve 100 acts on the stop element 165. The closing spring 155 is prestressed, in order to exert a spring force Ff on the valve needle 135, which spring force Ff preloads the valve needle 135 in the direction of a closed position 230. In the closed position 230, the closing element 145 is in sealing contact with the valve seat 150.

In addition, the fuel injection valve 100 has an electromagnetic actuator assembly 120 which has a coil 125, a pole piece 127 and a magnet armature 130. The pole piece 127 is stationary with regard to the valve body 160. For example, it is fastened to the valve body 160 or is configured in one piece with the latter.

The magnet armature 130 is arranged in the valve body 160 and is mounted such that it can be displaced with respect to the valve body 160. In addition, it is mounted such that it can be displaced with respect to the valve needle 135, to be precise between the stop element 165 and a disk 180 which are both connected fixedly to a shank of the valve needle 135.

The coil 125 is configured to generate a magnetic force Fm on the magnet armature 130 when it is energized for releasing the fuel flow through the injection opening 115. The magnetic force Fm moves the magnet armature 130 toward the pole piece 127, the magnet armature 130 first of all covering an idle stroke 220 toward the stop element 165, from which it is spaced apart in a currentless rest state of the fuel injection valve 100, before it enters into a positively locking connection with the stop element 165, with the result that it drives the valve needle 135 on its further path in the direction of the pole piece 127, with the result that the valve needle 135 is moved away from the closed position 230 and thus releases the fuel flow through the injection opening 115.

A stopper 170 which is formed in the present case by an end of the pole piece 127 which faces the magnet armature 130 limits the axial movability of the magnet armature 130 toward the pole piece 127. In an open position 215, 235 of the valve assembly 105, the magnet armature 130 bears against the stopper 170, and the stop element 165 bears against the magnet armature 130.

In the fuel injection valve 100 shown in FIG. 1, the idle stroke 220 is ensured by means of a permanent magnet 175 which exerts an armature restoring force Fr which is directed away from the pole piece 127 on the magnet armature 130. The armature restoring force Fr which is exerted by the permanent magnet 175 decreases greatly with the spacing of the magnet armature 130 from the permanent magnet 175, with the result that it does not damp, or damps merely slightly, in particular, the contact of the magnet armature 130 on the pole piece 127 at the end of the opening movement. This leads to overshooting of the valve needle 135 and to oscillations of the valve needle 135 about the open position 235 of the valve needle 135, in which open position 235 the stop element 165 is in positively locking contact with the magnet armature 130, whereas the magnet armature 130 is in positively locking contact with the pole piece 127.

Figure 4:
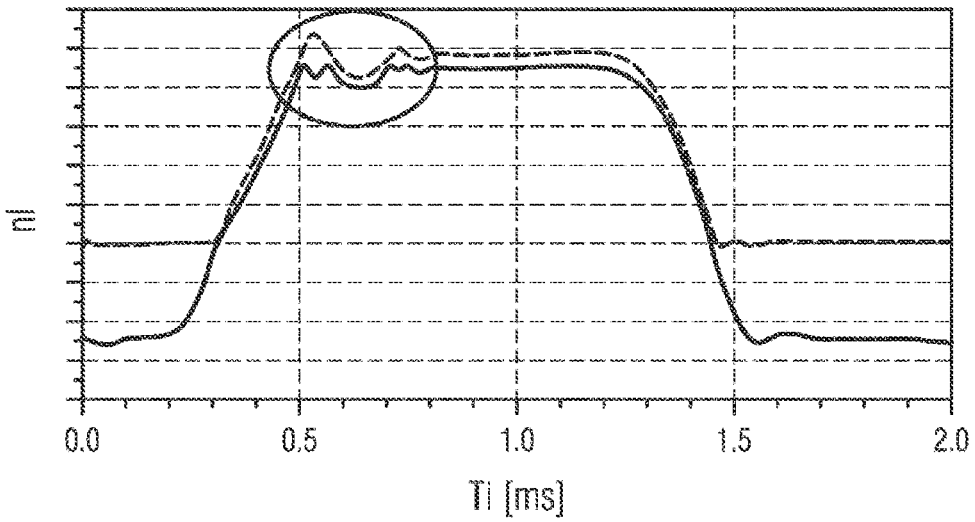
FIG. 4 shows a diagram of the needle position and the position of the magnet armature in a manner which is dependent on the opening duration in the known fuel injection valve.

These oscillations are shown by way of example in FIG. 4 which shows the spacing nl of the valve needle 135 from the valve seat 150 (dashed line) and the position of the magnet armature 130 (solid line) in a manner which is dependent on the opening duration Ti of the fuel injection opening 115. Here, the opening duration Ti is, in particular, the duration of an electric current signal which is applied to the coil 125.

Figure 3:
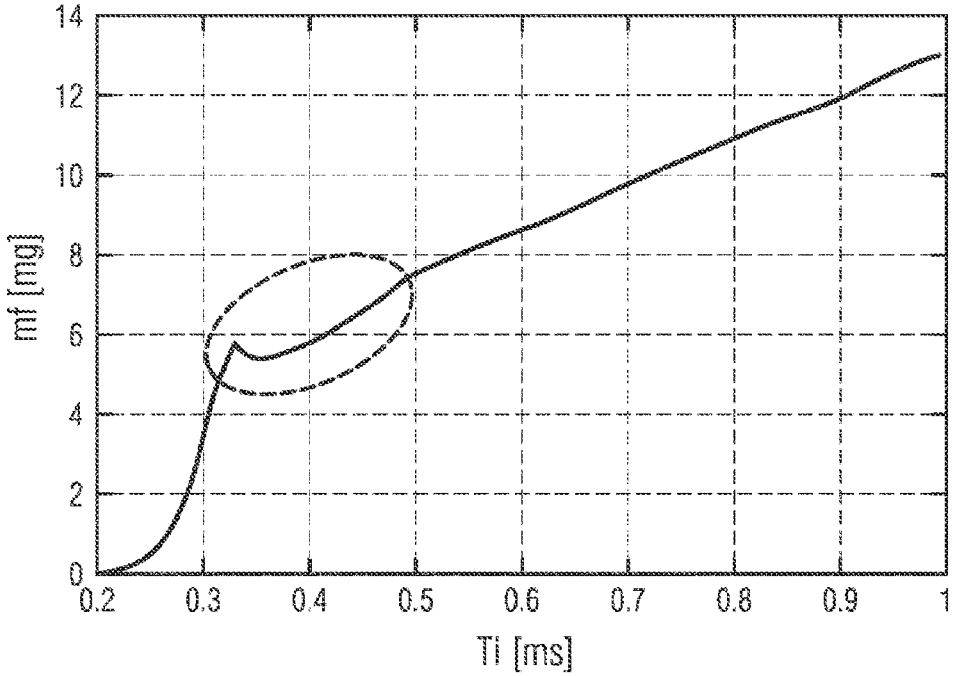
FIG. 3 shows a diagram of the fuel quantity which is output by the known fuel injection valve in a manner which is dependent on the opening duration.

The oscillatory profile of the needle position can be seen in the region which is marked by means of a circle. It leads to the non-linearity of the injection quantity mf which is marked in FIG. 3 by means of the dashed ellipse in a manner which is dependent on the opening duration Ti in the fuel injection valve 100 of FIG. 1.

Figure 2:
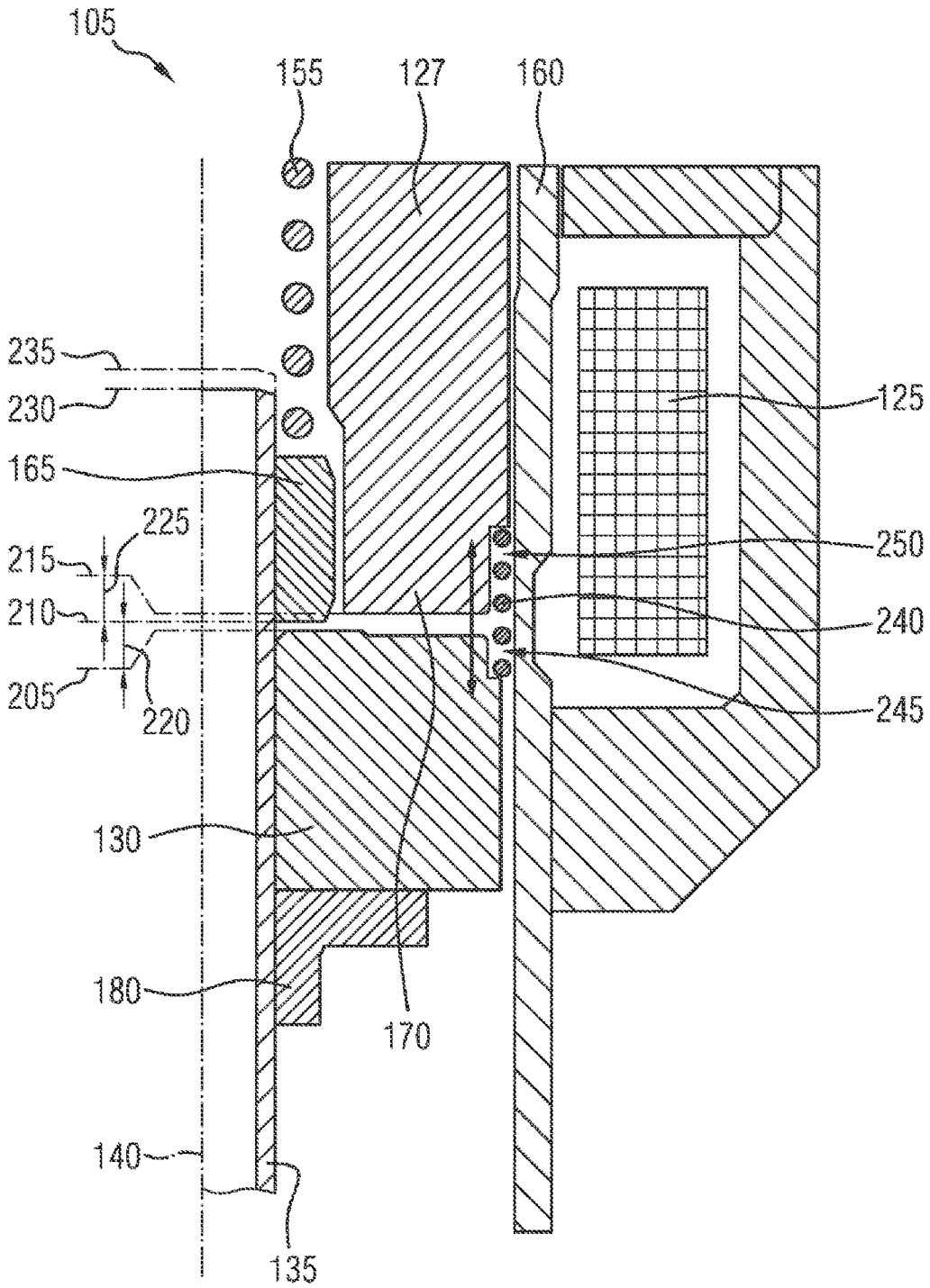
FIG. 2 shows a diagrammatic longitudinal section of a detail of a fuel injection valve according to the disclosure.

In contrast, FIG. 2 shows a detail of a fuel injection valve 100 according to the disclosure which corresponds fundamentally to the known fuel injector valve 100 which is described in conjunction with FIG. 1. FIG. 2 shows a detail of the valve assembly 105 of the fuel injection valve 100 in a longitudinal section. Here, only the right-hand half (in the plane of the drawing) of the valve assembly 105 is shown for reasons of simplification.

In contrast to the fuel injection valve 100 of FIG. 1, the idle stroke 220 of the magnet armature 130 is ensured by means of an armature restoring spring 240. The permanent magnet 175 described in FIG. 1 can advantageously be dispensed with. Opposite ends of the armature restoring spring 240 can be supported, for example, against the stopper 170 and against the magnet armature 130, as shown in FIG. 2. Cutouts 245, 250 may be provided in the magnet armature 130 and in the stopper 170 in order to receive the respective ends.

If the stopper is different than the pole piece 127, one end of the armature restoring spring 240 can also be supported against the pole piece 127 itself. In the present case, the armature restoring spring 240 follows the magnet armature 130 and the stopper 170 in the radial direction. As an alternative, the ends of the armature restoring spring 240 can also be arranged in central passage openings of the magnet armature 130 and/or the stopper 170 or the pole piece 127. In some examples, one end of the armature restoring spring is not supported against the stopper 170, but rather against the valve needle 135, for example, against the stop element 165. Details with respect to the arrangement and design of the armature restoring spring 240, stop element 165 (also called driver), magnet armature 130 and stopper 170 or pole piece 127 are disclosed in German patent application no. 10 2013 219 974.0, the disclosure of which is to this extent included herewith in the present disclosure by way of back-reference.

In the non-energized rest state of the fuel injection valve 100, the magnet armature 130 is situated in a first position 205 with respect to the spring loading by way of the armature restoring spring 240, in which first position 205 it is spaced apart from the stop element 165 of the valve needle 135. A magnetic force Fm is generated on the magnet armature 130 by means of loading of the coil 125 with an operating current, in order to axially displace the magnet armature 130 with respect to the valve needle 135 by the idle stroke 220 from the first position 205 counter to the spring force of the armature restoring spring 240, until it comes into contact with the stop element 165 in a second position 210.

From there, it is displaced by means of the magnetic force Fm by the actuating path 225 to a third position 215, in which it comes into contact with the stopper 170. On the actuating path 225, the magnet armature 130 drives the valve needle by means of the stop element 165 from the closed position 230 to the open position 235 counter to the spring force Ff of the closing spring 155. In the open position of the valve assembly 105, the magnet armature 130 is in positively locking contact with the stopper 170 in the third position 215, and the valve needle 135 is in the open position 235, its stop element 165 being in positively locking contact with the magnet armature 130.

The fuel injector valve 100 is designed, for example, for operation at a nominal pressure of 350 bar. In some examples, fuel injector valve 100 is designed to open up to a maximum fuel pressure of 420 bar. in some examples, the spring constant of the closing spring 155 has a value of 100 N/mm or more, such as, but not limited to 300 N/mm. In contrast, in the known fuel injection valve of FIG. 1, the spring constant of the closing spring 155 is only 14 N/mm. In some examples, the closing spring is prestressed with a force between 10 N and 30 N, the limit values being included. In some examples, the prestress is 20 N.

The actuator assembly is designed, for example, for a maximum operating current with a value between 10 A and 20 A, the limit values being included. in some implementations, actuator assembly is designed for a maximum operating current of 12 A. In some examples, the inductance of the coil 125 has a value between 0.1 mH and 10 mH, the limit values being included, for example a value of 2 mH. Here, the inductance is measured, for example, in the closed state of the fuel injector valve 100 (that is to say, magnet armature 130 in the first position 205 and valve needle 135 in the closed position 230). The inductance in the closed state may have a value between 2 mH and 4 mH. If the magnet armature 130 is in the second position 210 and the coil is loaded with the maximum operating current of 12 A, the inductance drops, for example, to a value between 0.16 mH and 0.8 mH.

The idle stroke 220 has, for example, a value between 40 μm and 120 μm, the limit values being included; in the present case, it is 40 μm. The actuating path 225 has, for example, a length of 40 μm or more, for example, between 40 μm and 100 μm, the limit values being included. In the present case, the actuating path 225 has a length of approximately 90 μm.

The spring constant of the closing spring 155 and the magnetic force of the actuator assembly 120 are adapted to one another in such a way that, in the case of a constant magnetic force Fm, the magnitude of the summed force of the spring force Ff and the magnetic force Fm decreases monotonously with an increasing spacing of the valve needle 135 from the closed position 230. In the open position 215, 235, the magnitude of the summed force has a value of 50% or less of the magnitude of the summed force when the valve needle 135 leaves the closed position 230 (magnet armature 130 in the second position 210). Here, the summed force in the open position 215, 235 is directed away from the closed position 230, with the result that the magnet armature 130 and the valve needle 135 are held in the open position 215, 235 by means of the magnetic force Fm.

At the same time, the summed force is so low that, after running through approximately 50 μm of the actuating path 225, the valve needle is accelerated only weakly toward the pole piece 127 and is braked by way of the flow resistance of the fuel in the valve body 160 for at least 15 μm, for example, for at least 30 μm ahead of the contact of the magnet armature 130 on the stopper 170. The velocity of the magnet armature 130 during contact with the stopper 170 is advantageously lower, for example lower by at least 30%, more specifically, lower by at least 60%, than in a position which corresponds to running through the first 50 μm of the actuating path.

Figure 5:
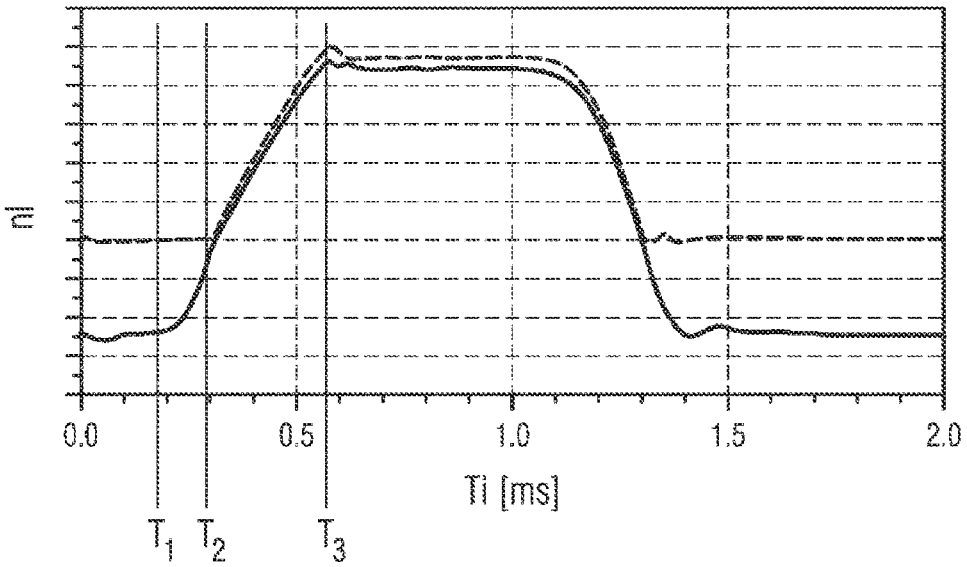
FIG. 5 shows a diagram of the needle position and the position of the magnet armature in a manner which is dependent on the opening duration in the fuel injection valve according to the disclosure.
Figure 6:
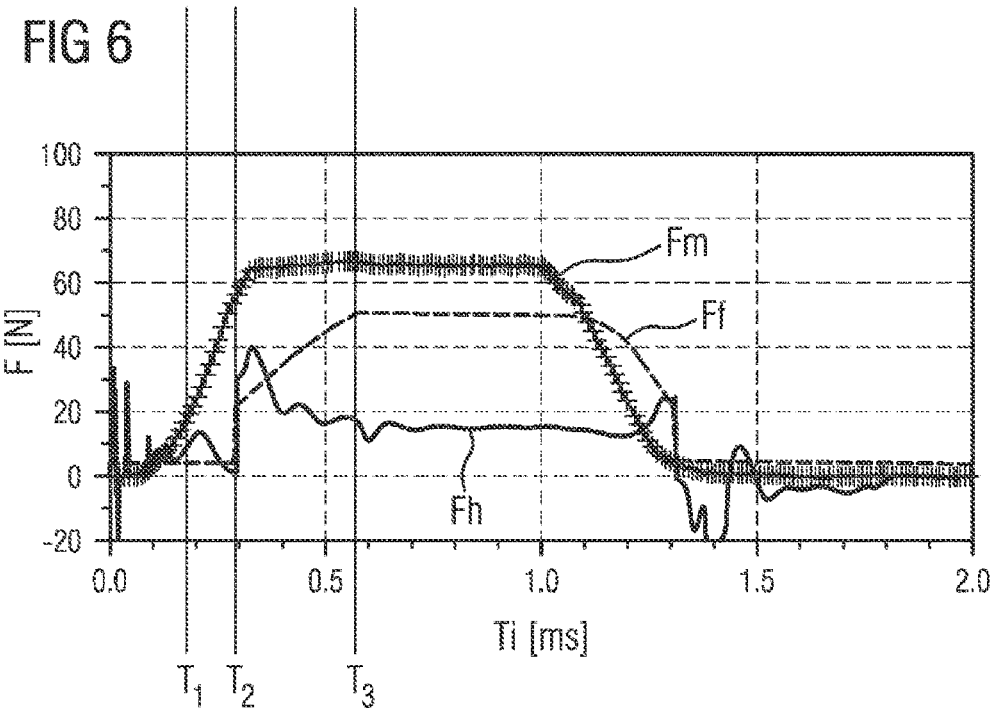
FIG. 6 shows a diagram of the magnetic force, the spring force and the hydraulic force in a manner which is dependent on the opening duration in the fuel injection valve according to the disclosure.

FIG. 6 shows the profile of the force F in a manner which is dependent on the opening duration Ti, that is to say on the duration of the electric current signal which is applied to the coil 125, for the magnetic force Fm, the spring force Ff and the force Fh which is exerted on the valve needle 135 by the fuel. Here, only the (positive) magnitudes of the spring force Ff and magnetic force Fm are plotted for improved clarity, although the two forces act in opposite directions. Against the same time axis, FIG. 5 shows the spacing nl of the valve needle 135 from the closed position 230 in a manner which is dependent on the opening duration Ti (dashed line) and the position of the magnet armature 130 (solid line).

After the coil current is switched on, the magnetic force Fm rises at first until, at a first time T1, first of all the movement of the magnet armature 130 away from the first position 205 begins and the magnet armature 130 subsequently comes into contact with the stop element 165 at a second time T2. At the second time T2, the movement of the valve needle 135 away from the closed position 230 begins. The magnetic force Fm is kept at least approximately constant from the time T2, by the operating current through the coil being lowered continuously from a maximum value to a holding current. In contrast, starting from the prestress, the spring force Ff rises from time T2 until it reaches its maximum value when the valve passes into the open position 215, 235 at a following, third time T3. In some examples, the maximum value of the spring force Ff corresponds approximately to 2.5 times the prestress.

The summed force of spring force Ff and magnetic force Fm has a value of approximately 40 N when the valve needle leaves the closed position 230 at the time T2 and only a value of approximately 15 N when the magnet armature 130 or the valve needle 135 comes into contact with the stopper 170 at the time T3. This corresponds to a reduction of the summed force to less than 40%.

In some examples, the magnitude of the magnetic force Fm is greater in both cases than the magnitude of the spring force Ff, with the result that the summed force is directed in each case in the opening direction. When the magnet armature 130 or the valve needle 135 comes into contact with the stopper 170 at time T3, the magnitude of the summed force is smaller, however, than the magnitude of the hydraulic force Fh, with which the fuel counteracts the movement of the valve needle 135, with the result that the valve needle is braked by way of the flow resistance of the fuel before reaching the open position 235.

The overshooting of the needle 135 beyond the open position 235 when the magnet armature 130 comes into contact with the stopper 170 is thus particularly low, and oscillations of the needle position are avoided. This is shown in FIG. 5 using the dashed line which represents the spacing nl of the valve needle 135 from the closed position 230 in a manner which is dependent on the opening duration Ti for the present fuel injection valve 100. The position of the magnet armature 130 also advantageously does not have an oscillating profile (see the solid line of FIG. 5). The injection quantity mf can thus be set in a particularly precise manner. The fuel injection valve 100 may be actuated particularly simply in order to achieve a predefined injection quantity Mf.

The force Fm of the magnet armature 130 of approximately 65 N on the valve needle 135 during the entering of the positively locking connection between the magnet armature 130 and the stop element 165 at time T2 corresponds approximately to 1.3 times the sum of the prestress of the closing spring 155 of 20 N in the present case and the hydraulic force of approximately 30 N which is exerted on the valve needle 135 by the fuel in the closed position 230. A sufficient force impact is thus ensured by means of the idle stroke and the magnet armature, in order to move the valve needle 135 away from the closed position 230.

A number of implementations have been described. Nevertheless, it will be understood that various modifications may be made without departing from the spirit and scope of the disclosure. Accordingly, other implementations are within the scope of the following claims.

What is claimed is:

1. A fuel injection valve comprising:

a valve assembly including a displaceably mounted valve needle comprising a stop element, and a valve seat which interact mechanically with valve needle, in order to prevent fuel flow through an injection opening of the fuel injection valve in a closed position of the valve needle and to release it in other positions of the valve needle;

a prestressed closing spring which exerts a spring force on the valve needle, the spring force loads the valve needle in a direction of the closed position;

an electromagnetic actuator assembly including:

a pole piece;

a magnet armature mounted to be displaceable with respect to the valve needle and spaced apart from the stop element of the valve needle in a rest state of the fuel injection valve;

a coil configured to generate a magnetic force on the magnet armature when it is energized in order to release the fuel flow through the injection opening, to move the magnet armature toward the pole piece; and a stopper which limits the movement of the magnet armature and/or the valve needle, wherein the magnet armature, on its way toward the pole piece, at first covers an idle stroke toward the stop element and subsequently enters into a positively locking connection with the latter, with the result that it drives the valve needle in the direction of the pole piece, wherein during a valve opening operation in which the coil is energized, a magnitude of a summed force of the spring force and the magnetic force decreases with an increasing spacing of the valve needle from the closed position to an open position in which the magnet armature or the valve needle bears against the stopper in the case of a constant or increasing magnetic force or, in the case of an increasing magnetic force, at least remains constant with an increasing spacing of the valve needle from the closed position, wherein the fuel injection valve further comprises an armature restoring spring which biases the magnet armature in a direction away from the stop element, wherein the pole piece includes a cutout formed in an outer radial portion thereof, the armature includes a cutout formed in an outer radial portion thereof, and the armature restoring spring is disposed in the cutout of the pole piece and the cutout of the armature.

2. The fuel injection valve of claim 1, wherein:

the actuator assembly holds the fuel injection valve in the open position, in which the magnet armature or the valve needle bears against the stopper, and the stop element of the valve needle is in contact with the magnet armature; and the spring force at least doubles with respect to the prestress from the closed position to the open position.

3. The fuel injection valve of claim 1, wherein a spring constant of the closing spring and the magnetic force of the actuator assembly cause the summed force, when the magnet armature or the valve needle comes into contact with the stopper, is directed away from the closed position and has a magnitude which is at most half as great as the magnitude of the summed force when the valve needle leaves the closed position.

4. The fuel injection valve of claim 1, wherein during the valve opening operation of the fuel injection valve, the valve needle is braked by way of the flow resistance of the fuel in the valve assembly if the spacing of the valve needle from the closed position exceeds a predefined value.

5. The fuel injection valve of claim 1, wherein the spring constant of the closing spring and the magnetic force of the actuator assembly cause the magnitude of the summed force to decrease monotonously with the spacing of the valve needle from the closed position.

6. The fuel injection valve of claim 1, wherein during the entering into the positively locking connection, a force of the magnet armature on the valve needle has a value of 1.3 times or more of a sum of the prestress force of the closing spring and a hydraulic force which is exerted on the valve needle by the fuel in the closed position.

7. The fuel injection valve of claim 1, wherein the fuel injection valve operates at a fuel pressure of 500 bar or less, and the spring constant of the closing spring being 100 N/mm or more.

8. A fuel injection valve comprising:

a valve assembly including a displaceably mounted valve needle comprising a stop element, and a valve seat which interacts mechanically with valve needle in order to prevent fuel flow through an injection opening of the fuel injection valve in a closed position of the valve needle and to release the flow of fuel in other positions of the valve needle;

at least one prestressed closing spring, each of the at least one prestressed closing spring exerting a spring force on the valve needle including when the valve needle is in the closed position, the spring force loads the valve needle in a direction of the closed position;

an electromagnetic actuator assembly including:

a pole piece;

a magnet armature displaceably mounted with respect to the valve needle and spaced apart from the stop element of the valve needle in a rest state of the fuel injection valve; and a coil configured to generate a magnetic force on the magnet armature when the coil is energized in order to release the fuel flow through the injection opening, to move the magnet armature toward the pole piece, wherein the magnet armature, on its way toward the pole piece, at first covers an idle stroke toward the stop element and subsequently enters into a positively locking connection with the latter, with the result that the magnet armature drives the valve needle in the direction of the pole piece, and wherein during a valve opening operation of the fuel injection valve in which current is passed through the coil, a magnitude of a summed force of the spring force and the magnetic force decreases with an increasing spacing of the valve needle from the closed position in the case of a constant or increasing magnetic force or, in the case of an increasing magnetic force, at least remains constant with an increasing spacing of the valve needle from the closed position, wherein the fuel injection valve further comprises a stopper which limits the movement of the magnet armature and/or the valve needle toward the pole piece, wherein the summed force, when the magnet armature or the valve needle contacts the stopper, is directed away from the closed position and has a magnitude which is at most half as great as the magnitude of the summed force when the valve needle leaves the closed position, the fuel injection valve further comprising an armature restoring spring which biases the magnet armature in a direction away from the stop element, wherein the pole piece includes a cutout formed in a radial portion thereof, the armature includes a cutout formed in a radial portion thereof, and the armature restoring spring is disposed in the cutout of the pole piece and the cutout of the armature, at least a portion of the pole piece being laterally disposed between the armature restoring spring and at least one of the closing spring and the stop element so that the armature restoring spring is non-adjacent the at least one of the closing spring and the stop element.

9. The fuel injection valve of claim 8, further comprising a stopper, wherein the actuator assembly holds the fuel injection valve in an open position, in which the magnet armature or the valve needle bears against the stopper, and the stop element of the valve needle is in contact with the magnet armature; and wherein the spring force at least doubles from the closed position to the open position.

10. The fuel injection valve of claim 9, wherein the stopper comprises an axial end portion of the pole piece.

11. The fuel injection valve of claim 8, wherein during the valve opening operation of the fuel injection valve, the valve needle is braked by way of the flow resistance of the fuel in the valve assembly if the spacing of the valve needle from the closed position exceeds a predefined value.

12. The fuel injection valve of claim 8, wherein the magnitude of the summed force decreases monotonously with the spacing of the valve needle from the closed position.

13. The fuel injection valve of claim 8, wherein during the entering into the positively locking connection, a force of the magnet armature on the valve needle has a value of at least 1.3 times a sum of the prestress of the closing spring and a hydraulic force which is exerted on the valve needle by the fuel in the closed position.

14. The fuel injection valve of claim 8, wherein the fuel injection valve operates at a fuel pressure of 500 bar or less, and the spring constant of the closing spring being 100 N/mm or more.

15. The fuel injection valve of claim 8, further comprising a stopper configured to limit the movement of the magnet armature and/or the valve needle, wherein the magnitude of a summed force of the spring force and the magnetic force decreases with an increasing spacing of the valve needle from the closed position to an open position in which the magnet armature or the valve needle bears against the stopper in the case of a constant or increasing magnetic force or, in the case of an increasing magnetic force, at least remains constant with an increasing spacing of the valve needle from the closed position.

16. A fuel injection valve comprising:

a valve assembly including a displaceably mounted valve needle comprising a stop element, and a valve seat which interacts mechanically with valve needle in order to prevent fuel flow through an injection opening of the fuel injection valve in a closed position of the valve needle and to release the flow of fuel in other positions of the valve needle;

a prestressed closing spring which exerts a spring force on the valve needle the spring force loads the valve needle in a direction of the closed position;

an electromagnetic actuator assembly including:

a pole piece;

a magnet armature displaceably mounted with respect to the valve needle and spaced apart from the stop element of the valve needle in a rest state of the fuel injection valve; and a coil configured to generate a magnetic force on the magnet armature when the coil is energized in order to release the fuel flow through the injection opening, to move the magnet armature toward the pole piece, wherein the magnet armature, on its way toward the pole piece, at first covers an idle stroke toward the stop element and subsequently enters into a positively locking connection with the latter, with the result that the magnet armature drives the valve needle in the direction of the pole piece, wherein a spring constant of the closing spring and the magnetic force of the actuator assembly are configured to cause a magnitude of the a summed force of the spring force and the magnetic force to decrease with an increasing spacing of the valve needle from the closed position in the case of a constant or increasing magnetic force or, in the case of an increasing magnetic force, at least remains constant with an increasing spacing of the valve needle from the closed position, wherein the fuel injection valve further comprises an armature restoring spring which biases the magnet armature in a direction away from the stop element, wherein the pole piece includes a cutout formed in an outer radial portion thereof, the armature includes a cutout formed in an outer radial portion thereof, and the armature restoring spring is disposed in the cutout of the pole piece and the cutout of the armature.

17. A fuel injection valve comprising:

a valve assembly including a displaceably mounted valve needle comprising a stop element, and a valve seat which interact mechanically with valve needle, in order to prevent fuel flow through an injection opening of the fuel injection valve in a closed position of the valve needle and to release it in other positions of the valve needle;

a prestressed closing spring which exerts a spring force on the valve needle, the spring force loads the valve needle in a direction of the closed position;

an electromagnetic actuator assembly including:

a pole piece;

a magnet armature mounted to be displaceable with respect to the valve needle and spaced apart from the stop element of the valve needle in a rest state of the fuel injection valve;

a coil configured to generate a magnetic force on the magnet armature when it is energized in order to release the fuel flow through the injection opening, to move the magnet armature toward the pole piece; and a stopper which limits the movement of the magnet armature and/or the valve needle, wherein the magnet armature, on its way toward the pole piece, at first covers an idle stroke toward the stop element and subsequently enters into a positively locking connection with the latter, with the result that it drives the valve needle in the direction of the pole piece, wherein during a valve opening operation in which the coil is energized, a magnitude of a summed force of the spring force and the magnetic force decreases with an increasing spacing of the valve needle from the closed position to an open position in which the magnet armature or the valve needle bears against the stopper in the case of a constant or increasing magnetic force or, in the case of an increasing magnetic force, at least remains constant with an increasing spacing of the valve needle from the closed position, wherein the fuel injection valve further comprises an armature restoring spring which biases the magnet armature in a direction away from the stop element, and wherein the pole piece includes a cutout formed in a radial portion thereof, the armature includes a cutout formed in a radial portion thereof, and the armature restoring spring is disposed in the cutout of the pole piece and the cutout of the armature, at least a portion of the pole piece being laterally disposed between the armature restoring spring and at least one of the closing spring and the stop element so that the armature restoring spring is non-adjacent the at least one of the closing spring and the stop element.

* * * * *